United States Patent [19]

McMaster

[11] 4,113,332

[45] Sep. 12, 1978

[54] SECRET COMPARTMENT CASE

[76] Inventor: James David McMaster, P.O. Box 55791, Houston, Tex. 77055

[21] Appl. No.: 843,566

[22] Filed: Oct. 19, 1977

[51] Int. Cl.[2] ..... A47B 97/00; A47B 17/04

[52] U.S. Cl. ..... 312/204; 109/54; 206/1.5; 312/330 SM; 312/348

[58] Field of Search ..... 312/204, 330, 348; 109/54, 50; 206/1.5

[56] References Cited

U.S. PATENT DOCUMENTS

| | | | |
|---|---|---|---|
| 128,439 | 6/1872 | Unna | 312/204 |
| 185,618 | 12/1876 | Zimmerman | 312/204 |
| 2,364,007 | 11/1944 | Stanton | 206/1.5 |
| 3,332,729 | 7/1967 | Dickson | 312/204 |

*Primary Examiner*—Kenneth Downey
*Assistant Examiner*—Alex Grosz
*Attorney, Agent, or Firm*—Pravel, Wilson & Gambrell

[57] ABSTRACT

A secret compartment case having a flexible housing, an inner drawer and an outer drawer, the flexible housing having a release member formed therewith for operatively connecting the inner drawer with the housing, the inner drawer being releasable from the housing to allow movement from a secured to an unsecured position when the outer drawer is moved from the shut position.

8 Claims, 4 Drawing Figures

Fig. 3
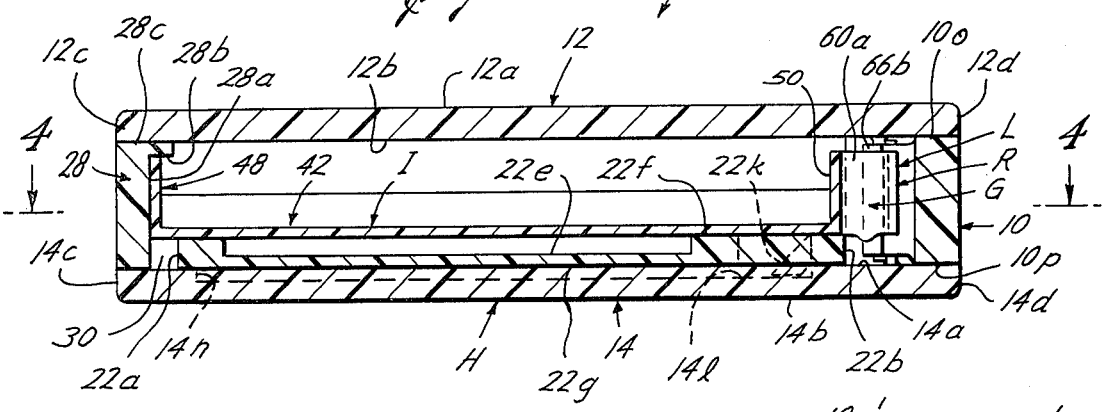
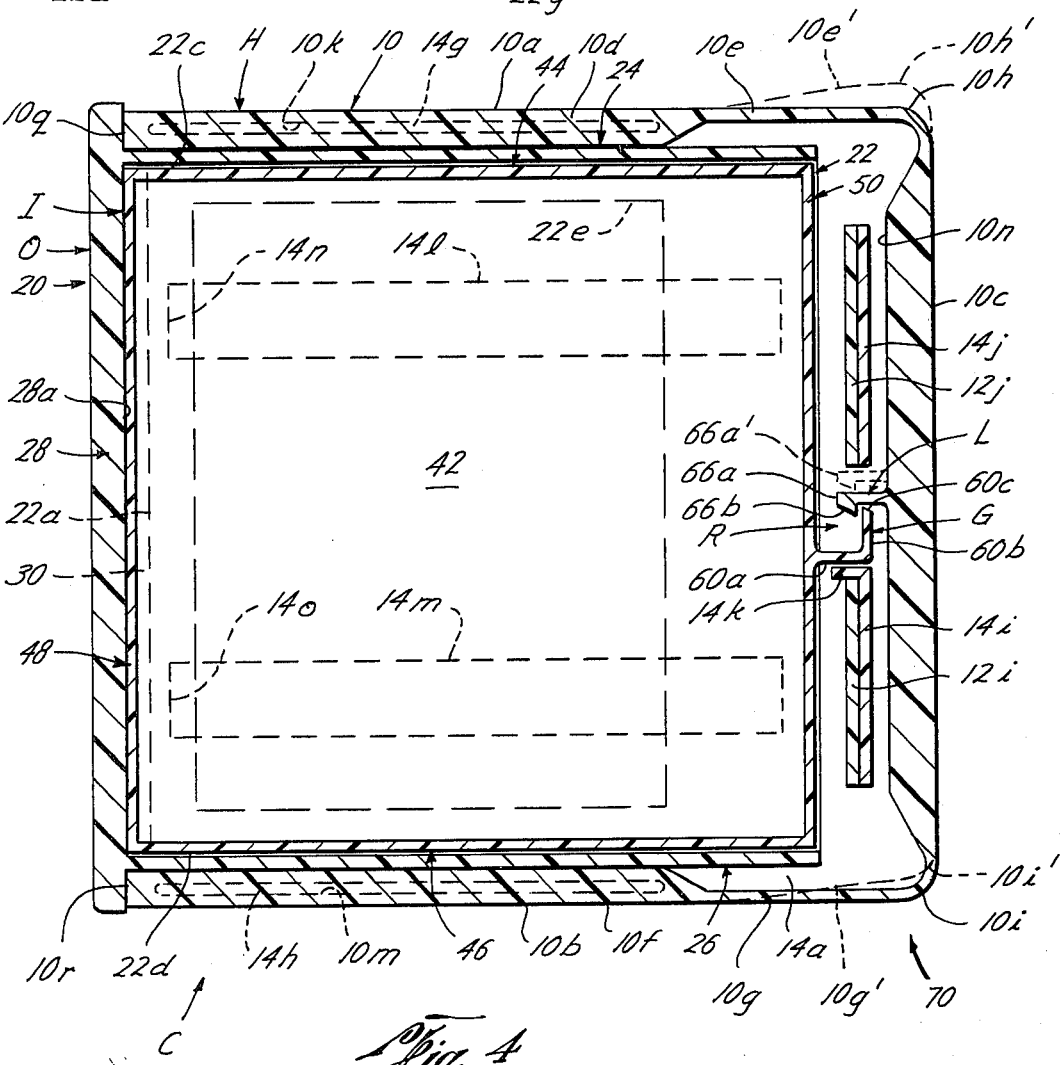
Fig. 4

SECRET COMPARTMENT CASE

BACKGROUND OF THE INVENTION

The present invention relates to cases and the like, particularly of the type having hidden or secret compartments therein.

It is well known that secret compartment cases have been used in the past for the purposes of protecting valuables and/or for amusement. In many of such devices, some type of mechanical release combination built into the housing having return springs, actuating levers and the like have been used in order to effectively prevent the exposure of such secret compartments unless such is desired, as is shown in U.S. Pat. Nos. 128,439; 144,636; 185,618; 513,061; 1,147,998; 1,466,362; and, 3,332,729. On the other hand, other prior art disclosures include constructions wherein false bottom drawers are built such as those disclosed in U.S. Pat. Nos. 723,050; 994,009; and, 2,362,017. So far as is known, no such secret compartment case is known that utilizes a flexible housing to release or expose the secret compartment of such a case.

SUMMARY OF THE INVENTION

The present invention relates to a new and improved secret compartment case having an outer drawer, a housing for receiving the outer drawer therein and an inner drawer to be disposed within the outer drawer in the housing. The secret compartment case of this invention includes release means formed with the housing operatively connecting the inner drawer and the housing for releasing the inner drawer from the housing to allow movement of the inner drawer from a secured position to an unsecured position when the outer drawer is displaced from the shut position with respect to the housing.

BRIEF DESCRIPTION OF THE DRAWINGS

FIG. 3 is a sectional, side view of the secret compartment case of the present invention, taken along the line 3—3 of FIG. 1; and, FIG. 4 is a sectional, top view of the secret compartment case of the present invention taken along the line 4—4 of FIG. 3.

DESCRIPTION OF THE PREFERRED EMBODIMENT

Figures 1, 2:
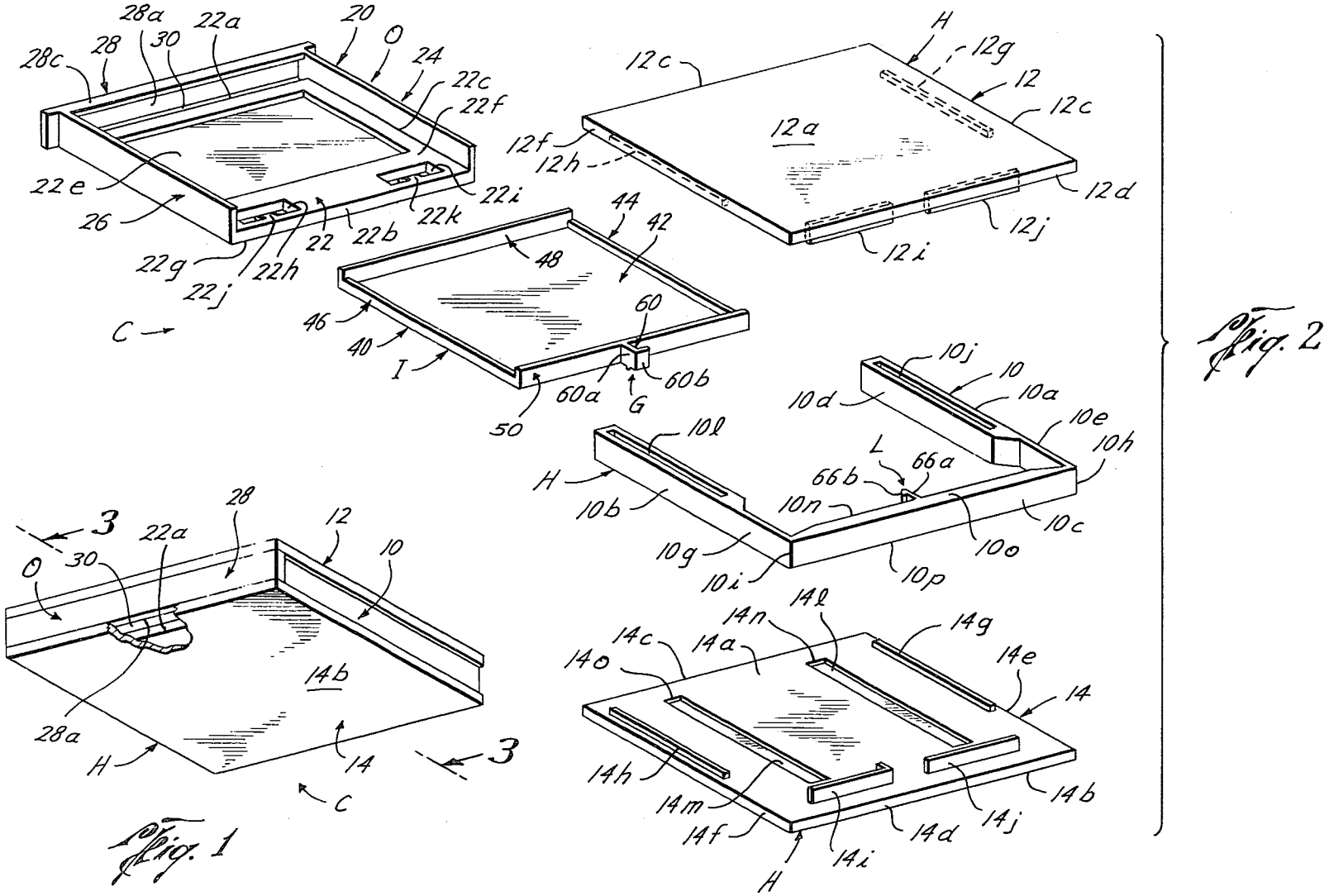
FIG. 1 is an isometric view of the bottom portion of the secret compartment case, partly in section, of the preferred embodiment of this invention.
FIG. 2 is an isometric, exploded view of the secret compartment case of the present invention.

Referring to the drawings, the letter C designates the secret compartment case in the preferred embodiment of this invention. The secret compartment case C includes a housing H, an outer drawer O, an inner drawer I and release means R formed with the housing H as described more fully hereinbelow. It is preferred that the secret compartment case C of the present invention be formed of any suitable material such as a plastic, such as polyvinylchloride, molded rubber, or any other suitable material capable of performing in accordance with the teachings of the present invention.

The secret compartment case C of the present invention includes a housing H. As shown in FIGS. 1–4, the housing H includes a frame member designated generally as 10, a top portion designated generally as 12, and a bottom portion designated generally as 14.

As shown in FIGS. 2 and 4, the frame member 10 of the housing H includes side walls **10*a*, 10*b* and back wall 10*c*. Side wall 10*a* includes reinforced portion 10*d* and flexing portion 10*e*. Side wall 10*b* includes reinforced portion 10*f* and flexing portion 10*g*. The back wall 10*c* of the frame member 10 is formed with the side walls 10*a*, 10*b* adjacent flexing portions 10*e*, 10*g* at flexing corners 10*h*, 10*i*, respectively. The flexing corners 10*h*, 10*i* may be square as shown in FIG. 2 or curved or rounded as shown in FIG. 4. The frame member 10 includes upper surface 10*o* and lower surface 10*p*. Detents 10*j*, 10*k* are formed with reinforced portion 10*d* of side wall 10*a* in the upper surface 10*o* and lower surface 10*p* thereof, respectively. Detents 10*l* and 10*m* are formed with the reinforced portion 10*f* of the side wall 10*b* in the upper surface 10*o* and lower surface 10*p*, respectively, thereof. A suitable latch means L, as described more fully hereinbelow, is formed with the interior surface 10*n* of the back wall 10*c***.

As shown in FIGS. 2 and 3, the top portion 12 of the housing H includes upper surface **12*a* and lower surface 12*b* and is preferably of a substantially rectangular and/or square configuration. The top portion 12 includes a front 12*c*, a rear 12*d* and sides 12*e*, 12*f*. Downwardly projecting lips 12*g*, 12*h* are formed with the lower surface 12*b* of the top portion 12 projecting downwardly from the lower surface 12*b*, being substantially parallel with sides 12*e*, 12*f*, respectively. In assembling the top portion 12 with the frame member 10, the downwardly projecting lips 12*g*, 12*h* are adapted to be received in detents 10*j*, 10*l*, respectively, of the frame member 10 with the lower surface 12*b* of the top portion 12 abutting upper surface 10*o* of the frame member 10 adjacent projecting lips 12*g*, 12*h*. Guide members 12*i*, 12*j* are formed with the lower surface 12*b* of the top portion 12 adjacent to and substantially parallel with the rear 12*d* and extending downwardly from the lower surface 12*b***, as discussed more fully hereinbelow.

The bottom portion 14 of the housing H of the secret compartment case C of the present invention includes an upper surface **14*a*, a lower surface 14*b*, front 14*c*, rear 14*d*, and sides 14*e*, 14*f*. Upward projecting lips 14*g*, 14*h* are formed with the upper surface 14*a* of the bottom portion 14, extending upwardly therefrom and being substantially parallel and adjacent to sides 14*e*, 14*f*, respectively. Guide members 14*i*, 14*j* are formed with the upper surface 14*a* extending upwardly therefrom adjacent and substantially parallel to rear 14*d*. Guide member 14*i* further includes guide portion 14*k* formed therewith and substantially perpendicular thereto. Slots 14*l*, 14*m* are formed in the upper surface 14*a* of the bottom portion 14 intermediate of sides 14*e*, 14*f* and substantially parallel to sides 14*e*, 14*f*, and projecting lips 14*g*, 14*h*. The slots 14*l*, 14*m* are preferably rectangular in configuration and are recessed from the upper surface 14*a* of the bottom portion 14, but preferably do not extend through the bottom portion 14 to lower surface 14*b***.

In the assembly of the housing H of the secret compartment case C of the present invention, the bottom portion 14 is affixed with the frame member 10 with lips **14*h* and 14*g* being received within detents 10*k*, 10*m* of the frame member 10, with guide members 14*i*, 14*j* abutting guide members 12*i*, 12*j* of the top portion 12 as shown in FIG. 4. As will be discussed more fully hereinbelow, the height between upper surface 10*o* and lower surface 10***p* of the frame member 10 is of a lesser dimension adjacent the flexing portions 10*e*, 10*g*, flexing corners 10*h*, 10*i*, and back wall 10*c* than adjacent the reinforced portions 10*d*, 10*f* where the top portion 12 and bottom portion 14 are engaged.

The secret compartment case C of the present invention further includes an outer drawer O. The outer drawer O includes outer drawer 20 having a base portion 22, sides 24, 26, and front portion 28. The base portion 22 includes front 22*a*, rear 22*b*, and sides 22*c*, 22*d*. The base portion 22 is formed with the sides 24, 26 adjacent sides 22*c*, 22*d*, respectively; however, front 22*a* of base portion 22, preferably does not abut the inner surface 28*a* of front portion 28, resulting in a gap 30 being formed therebetween.

The front portion 28 is formed with sides 24, 26 such that the inner surface 28*a* of the front portion 28 abuts sides 24, 26 and is formed therewith. As shown in FIG. 3, lip 28*b* is preferably formed adjacent to inner surface 28*a* of front portion 28 with the lip 28*b* being formed along the length of the front portion 28 between sides 24, 26. It is preferred that the gap 30 provide access to machine or suitably form such lip 28*b* in the front portion 28 for manufacturing purposes. It is understood that if the lip 28*b* may be formed properly for its intended purposes by any other means as described more fully hereinbelow, then, there is no need for gap 30 to exist in the outer drawer O. However, so far as presently known, gap 30 provides access to and for the manufacture of lip 28*b*.

A recess 22*e* is preferably formed in the upper surface 22*f* of the base portion 22 of the outer drawer 20. Preferably, the recess 22*e* extends from the upper surface 22*f* downwardly into the base portion 22, but does not extend through to the lower surface 22*g* of the base portion 22. The recess 22*e* is for storing any desired articles of lesser dimension than the recess 22*e*, as discussed more fully hereinbelow. Openings 22*h*, 22*i* are formed in the base portion 22 adjacent rear 22*b* thereof. Depending fingers 22*j*, 22*k* extend into openings 22*h*, 22*i*, respectively, and below the lower surface 22*g* of the base portion 22 as shown in FIG. 3.

The secret compartment case C of the present invention further includes an inner drawer I. The inner drawer I includes inner drawer 40 having a base portion 42, sides 44, 46, front wall portion 48, and rear wall portion 50, all of which are preferably molded together of any suitable material. The sides 44, 46 are preferably of lesser height than the front wall portion 48 and rear wall portion 50. The rear wall portion 50 further has an appropriate gate means G as discussed more fully hereinbelow formed therewith. The inner drawer 40 is adapted to be disposed within the outer drawer 20 and is of such a dimension that the height of the front and rear wall portions 48, 50 is slightly less than that distance between the upper surface 22*f* of base portion 22 and lip 28*b* of front portion 28 of outer drawer 20 allowing the front wall portion 48 to fit beneath the lip 28*b* when the front wall portion 48 of the inner drawer 40 abuts the front portion 28 of outer drawer 20.

The release means R of the secret compartment case C of the present invention is preferably formed with the housing H for operatively connecting the inner drawer I and housing H for releasing the inner drawer I from the housing H to allow movement of the inner drawer I relative thereto. The release means R preferably includes the latch means L formed with the back wall 10*c* of the frame member 10 of the housing H and gate means G formed with the rear wall portion 50 of the inner drawer 40. Preferably, the gate means G includes a gate 60 that extends rearwardly of and is formed with the rear wall portion 50 for engaging the latch means L. The gate 60 preferably includes a rearwardly extending portion 60*a* that is substantially parallel with sides 44, 46 and a transverse portion 60*b* that is substantially parallel with rear wall portion 50. The latch means L includes a latch 66 that includes a forwardly projecting portion 66*a* having a depending finger 66*b*, with forwardly projecting portion 66*a* being substantially parallel with side walls 10*a*, 10*b* and finger 66*b* being substantially transverse to and parallel with back wall 10*c*.

In the use or operation of the secret compartment case C of the present invention, the outer drawer O is adapted to be received in housing H for lateral movement between an open position and a shut position. The outer drawer O is shown in FIGS. 1, 3 and 4 as being in a shut position and is in such a shut position when the inner surface 28*a* of the front portion substantially abuts the end surfaces 10*q*, 10*r*, of the side walls 10*a*, 10*b*, respectively (FIG. 4). The outer drawer 20 is capable of lateral movement with respect to the housing H with depending fingers 22*j*, 22*k* of base portion 22 engaging slots 14*m*, 14*l*, of bottom portion 14, respectively such that the outer drawer O may move between the shut position of FIG. 4 to that of a fully opened position (not shown) to such point where depending fingers 22*f* engage the forwardmost surfaces 14*n*, 14*o* of slots 14*l*, 14*m*, respectively, limiting the maximum open position thereof and preventing separation of the outer drawer O with respect to the housing H. Thus, the depending fingers 22*j*, 22*k* cooperation with slots 14*l*, 14*m* act as a drawer guide means for operatively connecting outer drawer O and the housing H for aligning the outer drawer O for lateral movement with respect to the housing H and preventing separation of the outer drawer O from housing H when the outer drawer O is in the open position.

The inner drawer I is adapted to be disposed substantially within the outer drawer O and the housing H as shown in FIGS. 3 and 4. The inner drawer I is mounted for movement with respect to the housing H between a secured position as shown clearly in FIGS. 3 and 4 wherein the inner drawer I is positioned within the housing H and not movable therefrom and an unsecured position (not shown) wherein the inner drawer I is movable from the housing H when the outer drawer O is moved from the shut position. The release means R formed with the housing H including gate means G and latch means L operatively connects the inner drawer I in the housing H. Actuation of the release means R allows the inner drawer I to move from the secured position to the unsecured position. In the secured position, the inner drawer I is prevented from moving laterally with respect to the housing H as shown in FIG. 4 because the transverse portion 60*b* of gate 60 is engaged by the finger portion 66*b* of latch 66. In this secured position, however, the outer drawer O is free to move between its open and shut position as defined hereinabove without the inner drawer moving with respect to the housing H. Thus, any desired articles of lesser dimension than the recess 22*e* formed in the base portion 22 of outer drawer 20 may be exposed or not depending on whether or not the outer drawer is in the open or shut position. For example and not by way of limitation, if the secret compartment case C of the present invention is of small dimension, suitable items such as business cards and the like may be placed within the recess 22e if desired.

However, if it is desired that the inner drawer I be allowed to move relative to the housing H, the release means R must be operated. As noted hereinabove, the side walls 10a, 10b of the frame member 10 is formed of reinforced portions 10d, 10f and flexing portions 10e, 10g, respectively as connected by back wall 10c through flexing corners 10h, 10i, respectively. Flexing portions 10e, 10g and flexing corners 10h, 10i will flex and be responsive to displacement upon an appropriate force such as one acting in the direction of arrow 70 in FIG. 4 being applied to the frame member 10. The frame member 10 being of a resilient material, results in flexing of the flexible portion 10e, 10g and flexing corners 10h, 10i. This displacement from its original position is designated by the dotted lines 10e', 10g', 10h' and 10i' in response to the flexing force acting in the direction of arrow 70. As a result, the forwardly projecting portion 66a of latch 66 is displaced from its original position to that denoted by 66a', with finger 66b no longer engaging or preventing lateral movement of the transverse portion 60b of the gate 60 of the gate means G. As such, the inner drawer I is now free to move from its secured position to any desired unsecured position. After the finger 66b of the latch means L is moved beyond the transverse portion 60b of the gate G, the force acting in the direction of arrow 70 may be released with the housing H correspondingly resuming in its original shape due to the resilient nature of the materials used in forming the frame member 10 thereof. For the most dramatic effect to be achieved with the secret compartment case C of the present invention, it is preferred that the outer drawer O be in a shut position when the inner drawer is in the secured position and upon flexing of the frame member 10, both the outer drawer O and inner drawer I move from their respective shut and secured positions to their open and unsecured positions, respectively, with coordinated action. As such, the front wall portion 48 of the inner drawer 40 is concealed by the lip 28b with the lip 28b acting as a concealment means for concealing the existence of inner drawer I when the inner drawer I is in the unsecured position and the outer drawer O is displaced from its shut position. Thus, to one looking from above, in plan perspective, all that is evident is the upper surface 28c of the front portion 28, thus concealing the front wall portion 48 of the inner drawer 40.

It will be appreciated that the maximum movement of the inner drawer I with respect to the housing H will be the same as that of the outer drawer O due to the drawer guide means, namely the depending fingers 22j, 22k and slots 14m, 14l, respective action therebetween. In this position the inner drawer I is unsecured and the outer drawer O is open thus allowing access to the contents within the inner drawer I. Any suitable articles may be stored or concealed in such inner drawer I as desired.

Upon closing of the outer drawer O, and consequently the inner drawer I due to the front wall portion 48 abutting the inner surface 28a of front portion 28 of outer drawer 20, the inclined surface 60c formed at the end of transverse portion 60b of the gate 60 engages the similarly formed inclined surface of the finger portion 66b of the latch 66, with guide portion 14k acting as a guide to ensure proper engagement between the gate means G and latch means L, and proper positioning with respect thereto. Thus, the guide portion 14k acts as a latching guide means for ensuring the proper positioning of the latch means L and the gate means G with respect to each other when the inner drawer I is moved from its unsecured position to its secured position.

Thus, with the frame member 10 being flexible the housing H is also flexible with the housing H being movable from a normal position as shown in FIG. 4 to the flexed position as indicated by 10e', 10g', 10h', 10i'. The flexing of the flexible housing H, that is, of the frame member 10, is accomplished by the top portion 12 and bottom portion 14 joining the frame member adjacent the reinforced portions 10d, 10f and with the top portion 12 and bottom portion 14 joining each other adjacent guide members 12i, 12j, 14i, 14j, respectively, thus allowing flexing movement of the flexible portion of the frame member 10, with the thickness between the upper surface 10o and lower surface 10p of the frame member 10 being slightly greater at the reinforcing portions 10d, 10f than at the flexing portions 10e, 10g, and flexing corners 10h, 10i.

The secret compartment case C of the present invention, depending upon the size thereof, may be used for any suitable purpose wherein one drawer is readily accessible and a second, concealed inner drawer I is releasable from a housing H upon flexing the housing H.

In most cases, the flexing feature of the housing H is not apparent to those who see the secret compartment case C of the present invention. Typically, one who is unaware of the flexing nature of the housing H needs to be instructed about the release means R and the flexing features in a fashion to release the inner drawer I when desired.

Thus, the secret compartment case of the present invention provides a new and improved device having a flexing portion of the housing H for releasing the inner drawer I capable of carrying items desired to be concealed while further having an outer drawer O for carrying articles that are not necessarily desirous of being concealed.

The foregoing disclosure and description of the invention are illustrative and explanatory thereof, and various changes in the size, shape and materials as well as in the details of the illustrated construction may be made without departing from the spirit of the invention.

I claim:

1. A secret compartment case, comprising:

a flexible housing being movable from a normal position to a flexed position;

an outer drawer adapted to be disposed in said flexible housing and movable between an open position and a shut position with respect to said flexible housing;

an inner drawer adapted to be disposed substantially within said outer drawer and said flexible housing, said inner drawer mounted for movement with respect to said flexible housing between a secured position wherein said inner drawer is positioned within said flexible housing and not movable therefrom while said flexible housing is in a normal position and an unsecured position wherein said inner drawer is movable from said flexible housing when said flexible housing is in said flexed position and said outer drawer is displaced from said shut position; and, release means operatively connecting said inner drawer and said flexible housing for releasing said inner drawer from said flexible housing to allow movement from said secured position to said unsecured position.

2. The secret compartment case of claim 1, wherein said release means includes:

latch means formed with said flexible housing for securing said inner drawer with said flexible housing when said flexible housing is in said normal position and said inner drawer is in said secured position;

gate means formed with said inner drawer for engaging said latch means when said flexible housing is in said normal position and said inner drawer is in said secured position for preventing relative movement between said flexible housing and said inner drawer; and, said latch means releasing said gate means upon movement of said flexible housing to said flexed position allowing movement of said inner drawer to said unsecured position.

3. The secret compartment case of claim 2, wherein:

said flexible housing includes a frame member;

said latch means includes:

a flexing portion of said frame member; and, a latch formed with said flexing member for engaging said gate means.

4. The secret compartment case of claim 9, wherein:

said inner drawer has a rear wall section; and, said gate means includes a gate extending rearwardly of and formed with said rear wall section for engaging said latch means.

5. The secret compartment case of claim 2, further including:

latching guide means formed with said flexible housing for insuring the proper positioning of said latch means and said gate means with respect to each other when said inner drawer is in said secured position.

6. The secret compartment case of claim 1, further including:

drawer guide means operatively connecting said outer drawer and said flexible housing for aligning said outer drawer for lateral movement with respect to said flexible housing and preventing separation of said outer drawer from said flexible housing when said outer drawer is in said open position.

7. The secret compartment case of claim 1, further including:

concealment means formed with said outer drawer for concealing the existence of said inner drawer when said inner drawer is in said unsecured position and said outer drawer is displaced from said shut position.

8. The secret compartment case of claim 1, wherein:

said outer drawer has a base portion; and, a recess is formed in said base portion for storing any desired articles of lesser dimension than said recess therein.

* * * * *